US007764023B2

(12) United States Patent
Zane

(10) Patent No.: US 7,764,023 B2
(45) Date of Patent: Jul. 27, 2010

(54) CAPACITIVE COUPLING TO AID IGNITION IN DISCHARGE LAMPS

(75) Inventor: Regan A. Zane, Superior, CO (US)

(73) Assignee: The Regents of the University of Colorado, Denver, CO (US)

( * ) Notice: Subject to any disclaimer, the term of this patent is extended or adjusted under 35 U.S.C. 154(b) by 1122 days.

(21) Appl. No.: 11/370,236

(22) Filed: Mar. 6, 2006

(65) Prior Publication Data

US 2006/0244393 A1 Nov. 2, 2006

Related U.S. Application Data

(60) Provisional application No. 60/658,757, filed on Mar. 4, 2005.

(51) Int. Cl.
*G05F 1/00* (2006.01)

(52) U.S. Cl. ..... 315/291; 315/289; 315/209 M; 315/209 R

(58) Field of Classification Search ..... 315/291, 315/307, 312, 209 R, 209 M, 209 CD, 106, 315/DIG. 5, DIG. 7, 289
See application file for complete search history.

(56) References Cited

U.S. PATENT DOCUMENTS 4,766,350 A * 8/1988 Husgen et al. ..... 315/207
5,742,132 A * 4/1998 Huber et al. ..... 315/209 R
5,808,402 A * 9/1998 Seiler et al. ..... 313/318.01
6,509,696 B2 * 1/2003 Bruning et al. ..... 315/246
7,119,495 B2 * 10/2006 Jang ..... 315/244
7,323,830 B2 * 1/2008 Adam et al. ..... 315/291

OTHER PUBLICATIONS

Yuasa, Kunio, et al., "A Low Power Consumption Fluorescent Lamp for LCD Backlighting", IEEE ICPS, Jun. 1996, p. 124.
Lin, Mu-Shen, et al., "A Cold-Cathode Fluorescent Lamp Driver Circuit with Synchronous Primary-Side Dimming Control", IEEE TIE, Apr. 1998, 45(2):249-255.
Kahl, John H., Understanding Cold Cathode Fluorescent Lamps (CCFL'S), Application Information Al-007, JKL Components Corp., Nov. 1998, pp. 1-5.

(Continued)

*Primary Examiner*—Haissa Philogene
(74) *Attorney, Agent, or Firm*—Hamilton, DeSanctis & Cha LLP

(57) ABSTRACT

A method and apparatus for aiding ignition in a discharge lamp is provided. In one embodiment, a method comprises: applying a voltage across a pair of electrodes of a discharge lamp and capacitively coupling the discharge lamp. The capacitive coupling of the discharge lamp induces a current in the lamp to lower an ignition voltage of the discharge lamp. In another embodiment, a circuit for aiding ignition in a discharge lamp comprising a first electrode and a second electrode is also provided. The circuit comprises a lamp drive circuit comprises a voltage source coupled to a first terminal and a current controller coupled to a second terminal. The first and second terminals are configured to couple to a corresponding one of the first electrode and the second electrode of the discharge lamp. The voltage source is configured to provide a voltage signal at the first terminal and the current controller is configured to control a current received via the second terminal. The circuit further comprises a conductive element configured to capacitively couple the discharge lamp. The conductive element is also configured to induce a current in the discharge lamp to lower an ignition voltage of the discharge lamp when the voltage is applied to the discharge lamp.

38 Claims, 5 Drawing Sheets

OTHER PUBLICATIONS

MAX1739 Evaluation Kit Data Sheet, Maxim Integrated Products, 2001, pp. 1-7.

Branas, Christian, et al., "Experimental Study of HPS Lamp Ignition by using LC Network Resonance", IEEE, 2002, pp. 473-478.

Cho, Tae S., et al., "Capacitive Coupled Electrodeless Discharge Backlight Driven by Square Pulses", IEEE TPS, Oct. 2002, 30(5):2005-2009.

Zhao, Jun, et al., "A Novel Low-Frequency Square Wave Electronic Ballast for Low-Wattage HID Lamps", IEEE, 2003, pp. 321-324.

Cho, Guangsup, et al., "Influence of Auxiliary Discharges on a Multi-Lamps Backlight for Large Area LCD TVs", Abstract of the 30th ICPS, Jun. 2003, p. 137.

Shen, Miaosen, et al., "Design of a Two-Stage Low-Frequency Square-Wave Electronic Ballast for HID Lamps", IEEE TIA, Mar./Apr. 2003, 39(2):424-430.

Cheng, Wei-Chung, et al., "Power Minimization in a Backlit TFT-LCD Display by Concurrent Brightness and Contrast Scaling", IEEE, 2004, pp. 25-32.

"Capacitive Coupling Effects on CCFL Lamp Ignition", APEC 2005 Digest, 2005, pp. 1-6.

Doshi, Montu, et al., "Low Frequency Architecture for Multi-Lamp CCFL Systems with Capacitive Ignition", IEEE, 2005, pp. 1072-1078.

Zane, R., et al., "Low Frequency Architecture for Multi-Lamp CCFL Systems", APEC 2005 Digest, 2005, pp. 1-6.

* cited by examiner

CAPACITIVE COUPLING TO AID IGNITION IN DISCHARGE LAMPS

CROSS-REFERENCE TO RELATED APPLICATIONS

This application claims the benefit of U.S. provisional application No. 60/658,757 entitled "Capacitive coupling ignition and method of parallel operation of discharge lamps" and filed by Regan Zane on 4 Mar. 2005, which is hereby incorporated by reference as though fully set forth herein.

BACKGROUND OF THE INVENTION a. Field of the Invention

The instant invention relates to capacitive coupling to aid ignition in discharge lamps.

b. Background

The popularity of thin, light-weight, wide screen televisions and computer monitors has resulted in tremendous interest and development of large screen liquid crystal display (LCD) televisions and monitors. The increase in LCD screen size has increased the demand for longer cold-cathode fluorescent lamps (CCFLs) and parallel architectures suitable for efficient drive of large CCFL arrays with high luminance uniformity and long life.

High frequency LCC resonant inverters, based on push-pull (Royer oscillators) or bridge (full or half) topologies are commonly used as electronic ballasts for powering single and dual CCFL backlighting systems. The resonant systems, generating sinusoidal waveforms of 25-100 KHz, have high losses associated with high frequency capacitive coupling, resonant circulating currents, and also cause luminance uniformity degradation due to the thermometer effect. As the number of lamps per system grows (some estimates are greater than forty), it may not be feasible to use an individual LCC drive for each lamp due to an increase in size, weight, cost, complexity of the enclosure design, and losses. While one solution is to drive multiple lamps with a single LCC ballast, such designs make it difficult to simultaneously maintain high efficiency, proper parallel lamp ignition, and individual lamp current regulation.

Lamp ignition, in particular, typically requires voltage levels significantly higher than the typical on-state operating voltage of the lamps due to a relatively high start-up impedance of the lamps, especially at DC or low-frequencies.

BRIEF SUMMARY OF THE INVENTION

A conductive element is used near a discharge lamp to induce a capacitance between the conductive material and a gas chamber of the discharge lamp.

In one embodiment, a method of aiding ignition in a discharge lamp is provided. The method comprises: applying a voltage across a pair of electrodes of a discharge lamp and capacitively coupling the discharge lamp. The capacitive coupling of the discharge lamp induces a current in the lamp to lower an ignition voltage of the discharge lamp.

A circuit for aiding ignition in a discharge lamp comprising a first electrode and a second electrode is also provided. The circuit comprises a lamp drive circuit comprises a voltage source coupled to a first terminal and a current controller coupled to a second terminal. The first and second terminals are configured to couple to a corresponding one of the first electrode and the second electrode of the discharge lamp. The voltage source is configured to provide a voltage signal at the first terminal and the current controller is configured to control a current received via the second terminal. The circuit further comprises a conductive element configured to capacitively couple the discharge lamp. The conductive element is also configured to induce a current in the discharge lamp to lower an ignition voltage of the discharge lamp when the voltage is applied to the discharge lamp.

A discharge lamp circuit for aiding ignition in a discharge lamp is also provided. The discharge lamp circuit comprises a discharge lamp comprising a first electrode and a second electrode; a lamp drive circuit, and a conductive element. The lamp drive circuit comprises a voltage source coupled to the first electrode of the discharge lamp. The voltage source is configured to provide a voltage signal at the first electrode, and the current controller is configured to control a current received via the second electrode. The conductive element is configured to capacitively couple the discharge lamp and to further induce a current in the discharge lamp to lower an ignition voltage of the discharge lamp when the voltage is applied to the discharge lamp.

The foregoing and other aspects, features, details, utilities, and advantages of the present invention will be apparent from reading the following description and claims, and from reviewing the accompanying drawings.

DETAILED DESCRIPTION OF THE INVENTION

Reducing ignition voltage of discharge lamps may lead to longer lamp life and reduced component stress and may further allow for smooth and simultaneous ignition of a parallel discharge lamp array with less electrode degradation than would otherwise occur. Cold-cathode fluorescent lamps (CCFLs) and most other discharge lamps are designed and specified for AC operation with typical operating voltages ranging from about 200 V rms to about 800 V rms and ignition voltages ranging from about 800 V to over 2 kV. In addition, ignition voltages required for a gradually applied DC voltage drive can be even higher than the rated voltages for AC operation.

Breakdown in a discharge lamp, such as a CCFL, comprises a process in which a gas disposed in a lamp tube changes from being electrically isolating to being electrically conductive and is associated with a process of creating ions and electrons. Starting at an active terminal of the discharge lamp, subsequent sections of a wall of the lamp tube are negatively charged. This surface charge electrically shields the inside of the tube and extends the cathode potential within the tube until the ionization front reaches the anode.

Capacitively coupling the discharge lamp to ground just prior to and/or during ignition, however, allows for significantly reduced ignition voltages, sometimes down to about a typical operating voltage of a particular discharge lamp. The capacitive coupling induces a current in a chamber of the discharge lamp. This current is associated with an induced movement of free electrons due to the changing electric field and the relatively low impedance of the parasitic capacitances back to the source prior to ignition. The induced current begins the ionization process that lowers the lamp impedance and facilitates a lower starting voltage for igniting the lamp 18 via the lamp driving circuit.

Figure 1:
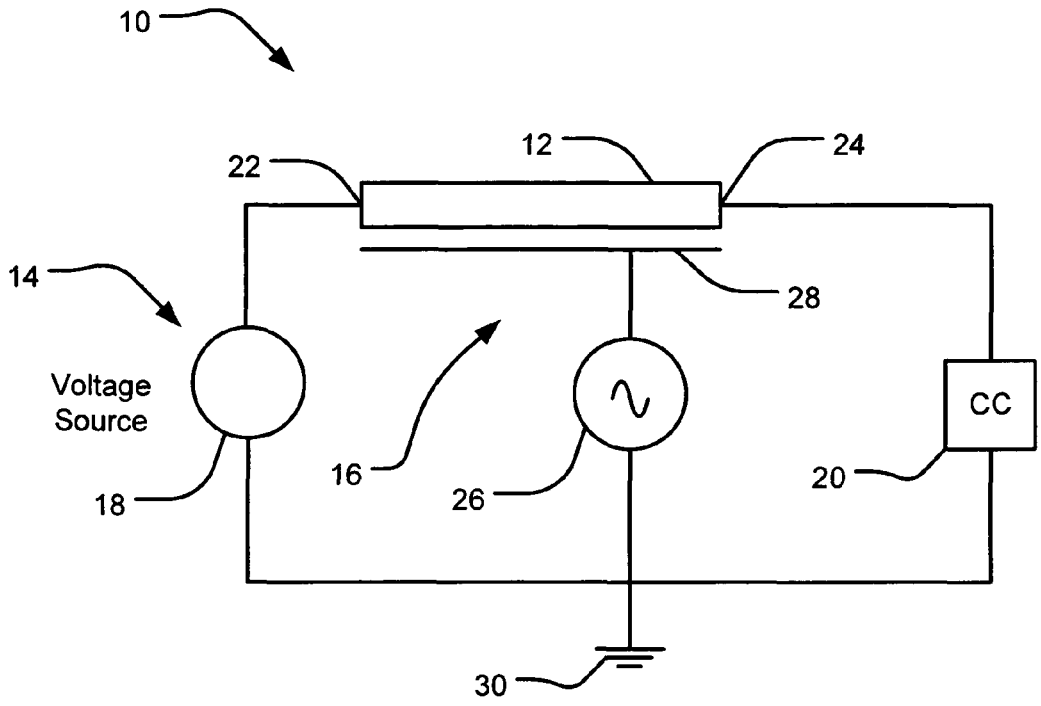
FIG. 1 shows a block diagram of an exemplary ballast circuit comprising capacitive coupling to aid ignition in a discharge lamp.

FIG. 1 shows a block diagram of an exemplary ballast circuit 10 comprising capacitive coupling to aid ignition in a discharge lamp 12. As shown in FIG. 1, the ballast circuit 10 comprises a lamp driving circuit 14 and a capacitive coupling circuit 16. The lamp driving circuit 14, in this embodiment, comprises a lamp driver voltage source 18 and a current controller 20. The lamp driver voltage source 18 may comprise, for example, a low-frequency voltage source (e.g., a DC source or a low-frequency square wave voltage generator), a relatively high-frequency voltage source (e.g., an AC drive), or any other voltage source useful for driving the discharge lamp 12. As used herein, the terms "low-frequency voltage signal" and "low-frequency voltage source" refer to voltage signals or sources of voltage signals having a fundamental frequency of less than or equal to about 1 kHz, including DC voltage signals and sources. The terms "high-frequency voltage signal" and "high-frequency voltage source" refer to voltage signals or sources of voltage signals having a fundamental frequency of greater than or equal to about 50 KHz. The driver voltage source 18 is coupled to the discharge lamp 12 via a first terminal 22 of the discharge lamp 12.

A second terminal 24 of the discharge lamp 12 is further coupled to the current controller 20 used to maintain a stable arc current following ignition and to regulate lamp current flowing through the discharge lamp 12 during normal operation of the lamp in order to provide a desired lumen output (e.g., to maintain a consistent lumen output across an array of discharge lamps).

The capacitive coupling circuit 16 comprises an ignition coupling driver 26 and a conductive element 28 (e.g., a conductive foil, plate, one or more strips, or other conductive material) disposed near the discharge lamp (e.g., juxtaposed along at least a portion of the discharge lamp). The ignition coupling driver 26, for example, may comprise a high-frequency voltage source, such as an AC voltage source for providing an AC signal (e.g., a sinusoidal AC voltage signal) to the conductive element 28, a pulse voltage source for providing one or more pulses having a predetermined peak voltage and pulse width, a pulse train voltage source for providing a pulse train voltage signal such as a square, triangular, or other shaped pulse train voltage signal. Discharge current induced in the lamp is a function of the coupling capacitance and driving voltage and frequency. Accordingly, many different waveforms may be generated by the ignition coupling driver that will aid ignition in the discharge lamp 12. In one embodiment, for example, a driving AC voltage signal having about 200 V peak to about 600V peak varying at frequencies ranging from about 50 kHz to about 300 kHz may be used.

Applying a high-frequency voltage to the conductive element 26 capacitively couples the discharge lamp 12 to a circuit ground 30. As described above, the capacitive coupling created by the high-frequency voltage signal being applied to the conductive element 28 induces a current in a chamber of the discharge lamp 12 and lowers the lamp impedance facilitating a lower starting voltage for igniting the lamp 12 via the lamp driving circuit. In one embodiment, for example, the capacitive coupling provides a lower ignition voltage of approximately a nominal on-state voltage of the discharge lamp.

In one embodiment, for example, the measured capacitance between the conductive element 26 and an electrode of the discharge lamp may be around 1 nF.

While the capacitive coupling effect can benefit high-frequency ballasts (e.g., where the lamp driver voltage source 12 comprises an AC voltage source) by reducing the lamp ignition voltage (e.g., during cold ignition or re-ignition for pulse-width-modulated (PWM) dimming), it can also create well-known drawbacks, such as reduced efficiency and poor luminance uniformity during normal operation (i.e., after the discharge lamp has been ignited). In order to avoid this so called "thermometer effect," significant measures are typically taken to reduce parasitic capacitance in order to improve efficiency and light quality of the discharge lamp.

By driving discharge lamps at a low-frequency (e.g., a low-frequency square wave of about 10 Hz), however, capacitive coupling may be used to provide smooth, soft lamp ignition while removing most concerns associated with efficiency loss due to AC coupling, electronic magnetic interference (EMI), and light quality.

The high-frequency voltage signal provided by the ignition coupling driver 26 may be applied to the conductive element 28 for a relatively short period of time prior to and/or during ignition of the discharge lamp 12 and then disconnected or turned off at or after the discharge lamp 12 is ignited. In one embodiment, for example, the ignition coupling driver 26 may be activated from less than about 100 μsec to about 100 msec before and/or during ignition of the discharge lamp. In another embodiment. In another embodiment, the ignition coupling driver 26 may be activated from about 10 to 100 msec before and/or during the ignition of the discharge lamp.

Figure 2:
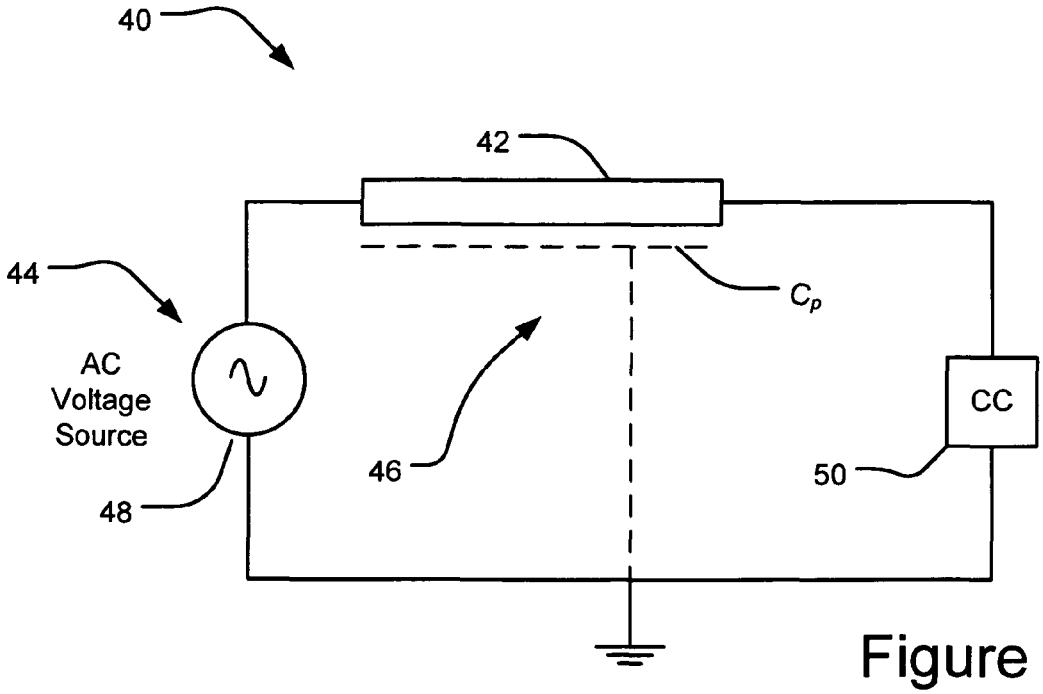
FIG. 2 shows a block diagram of another exemplary ballast circuit comprising capacitive coupling to aid ignition in a discharge lamp.

FIG. 2 shows a block diagram of another exemplary ballast circuit 40 comprising capacitive coupling to aid ignition in a discharge lamp 42. As shown in FIG. 2, the ballast circuit 40 comprises a lamp driving circuit 44 and a parasitic capacitance $C_p$ coupling the discharge lamp 42 to ground. The lamp driving circuit 44 comprises a high-frequency lamp driver voltage source 48 and a current controller 50. The high-frequency lamp driver voltage source 48 provides a high-frequency voltage signal to a terminal of the discharge lamp and the time-varying waveform of the high-frequency voltage signal capacitively couples the discharge lamp 42 with ground via the parasitic capacitance $C_p$. The parasitic capacitance $C_p$, for example, may be a normally occurring parasitic capacitance of the discharge lamp 42 and/or the ballast circuit 40 or may be designed, such as by customizing a housing for the discharge lamp using conductive elements to provide a desired level of capacitance.

During ignition of the discharge lamp 42, the high-frequency lamp driver voltage source 48 can be slowly ramped up to a level below a voltage required to ignite the discharge lamp 42. The high frequency voltage capacitively couples the discharge lamp to ground via the parasitic capacitance $C_p$. "Ground" as used within the scope of the invention may include any reference or common point in a circuit. While ground may refer to an "earth ground" of a circuit, the term ground herein is not limited to such an earth ground of a circuit. As described above with respect to FIG. 1, the capacitive coupling caused by high-frequency voltage and the parasitic capacitance $C_p$ can be used to induce a current flow within the discharge lamp thereby lowering the impedance of the discharge lamp 42 and correspondingly lowering the voltage required to ignite the discharge lamp 42.

Figure 3:
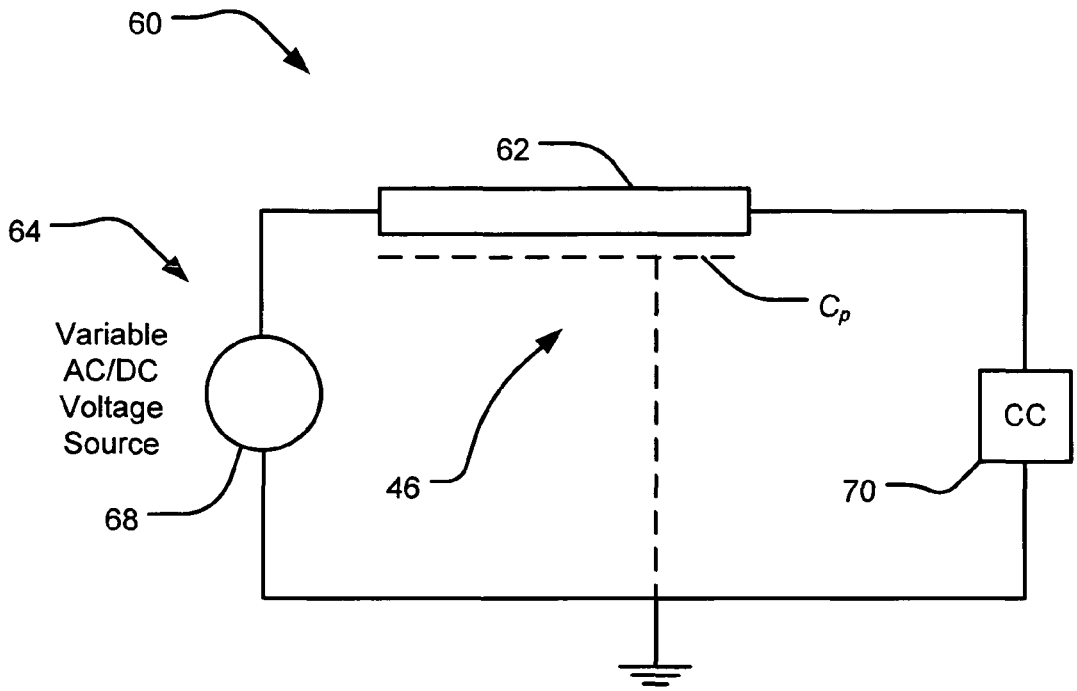
FIG. 3 shows a block diagram of another exemplary ballast circuit comprising capacitive coupling to aid ignition in a discharge lamp.

FIG. 3 shows a block diagram of another exemplary ballast circuit 60 comprising capacitive coupling to aid ignition in a discharge lamp 62. As shown in FIG. 3, the ballast circuit 60 comprises a lamp driving circuit 64 and a parasitic capacitance $C_p$ coupling the discharge lamp 62 to ground. The lamp driving circuit 64 comprises a variable AC/DC lamp driver voltage source 68 and a current controller 70. The variable AC/DC lamp driver voltage source 68 provides a high-frequency voltage signal (e.g., an AC voltage signal) to a terminal of the discharge lamp during ignition of the discharge lamp 62 and provides a low-frequency voltage signal to the terminal during normal operation of the discharge lamp 62.

During ignition, the time-varying waveform of the high-frequency voltage signal capacitively couples the discharge lamp 62 with ground via the parasitic capacitance $C_p$. The high-frequency voltage signal provided by the variable AC/DC lamp driver voltage source 68 during ignition can be slowly ramped up to a level below a voltage required to ignite the discharge lamp 62 as described above with respect to FIG. 2. The high-frequency voltage signal capacitively couples the discharge lamp to ground via the parasitic capacitance $C_p$. As described above with respect to FIG. 1, the capacitive coupling caused by high-frequency voltage signal and the parasitic capacitance $C_p$ can be used to induce a current flow within the discharge lamp thereby lowering the impedance of the discharge lamp 62 and correspondingly lowering the voltage required to ignite the discharge lamp 62.

During normal operation, however, after the discharge lamp 62 has been ignited, the variable AC/DC lamp driver voltage source 68 provides a low-frequency voltage signal to the discharge lamp 62. The low-frequency voltage signal at least substantially eliminates drawbacks associated with operating the discharge lamp with a high-frequency drive, such as the capacitive coupling of the discharge lamp 62 due to the parasitic capacitance $C_p$, the corresponding thermometer effect, luminance uniformity degradation, and electromagnetic interference (EMI). Thus, a high-frequency voltage signal may be used to lower the ignition voltage of the discharge lamp, while a low-frequency voltage signal may be used to eliminate the thermometer effect on the discharge lamp during normal operation of the lamp.

Figure 4:
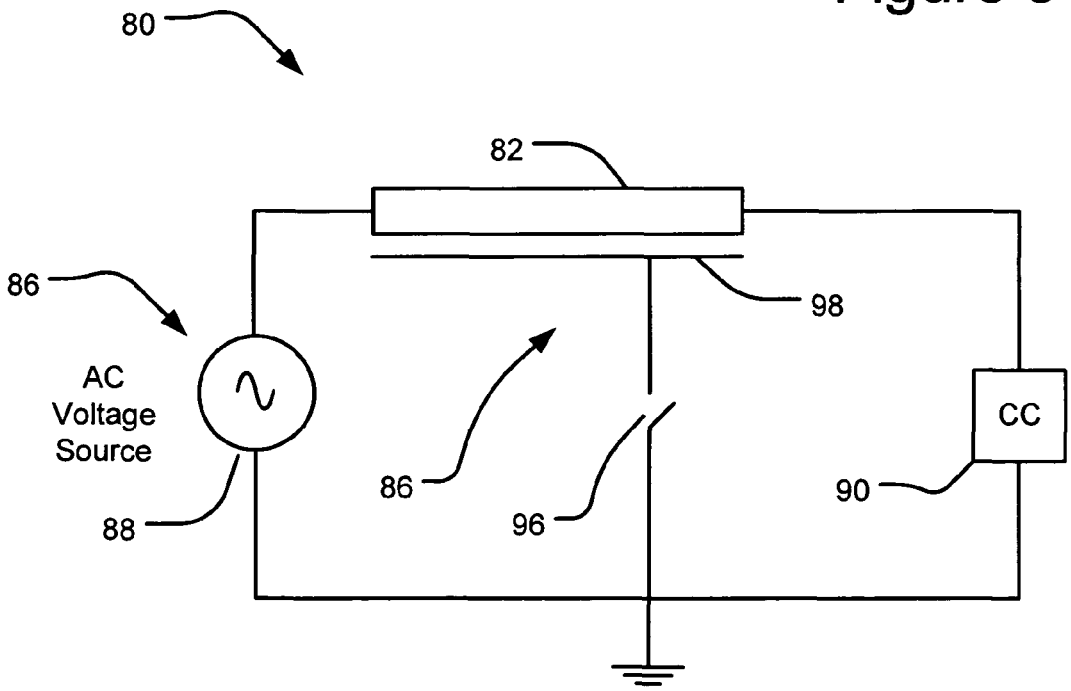
FIG. 4 shows a block diagram of another exemplary ballast circuit comprising capacitive coupling to aid ignition in a discharge lamp.

FIG. 4 shows a block diagram of another exemplary ballast circuit 80 comprising capacitive coupling to aid ignition in a discharge lamp 82. As shown in FIG. 4, the ballast circuit 80 comprises a lamp driving circuit 84 and a capacitive coupling circuit 86. The lamp driving circuit 84 comprises a high-frequency lamp driver voltage source 88 and a current controller 90. The capacitive coupling circuit comprises a switch 96 (e.g., a relay, FET, or other switching device) and a conductive element 98. The switch 96 can be controlled to selectively couple the conductive element 98 to ground or isolate the conductive element 98 from ground During ignition, the switch 96 couples the conductive element 98 to the circuit ground, which in turn capacitively couples the discharge lamp 82 to ground. The capacitive coupling of the discharge lamp to ground induces a current flow within the discharge lamp thereby lowering the impedance of the discharge lamp 82 and correspondingly lowering the voltage required to ignite the discharge lamp 82.

During normal operation, however, after the discharge lamp 82 has been ignited, the switch 96 isolates the conductive element 98 from the circuit ground thereby eliminating the capacitive coupling of the discharge lamp 82 caused by the conductive element 98 and the corresponding thermometer effect.

Figure 5:
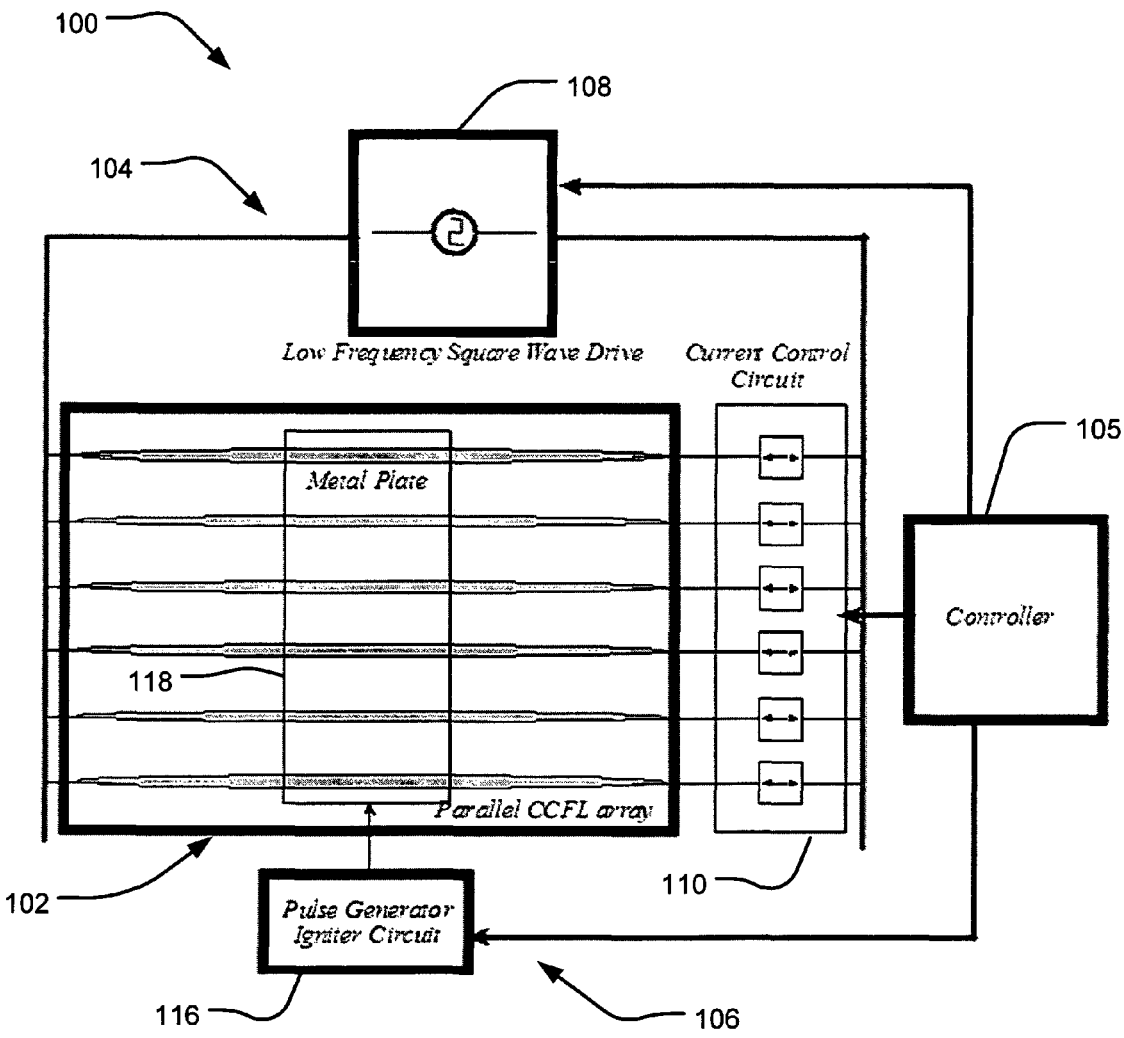
FIG. 5 shows a block diagram of yet another exemplary ballast circuit 100 comprising capacitive coupling to aid ignition in an array of parallel-connected discharge lamps.

FIG. 5 shows a block diagram of yet another exemplary ballast circuit 100 comprising capacitive coupling to aid ignition in an array 102 of parallel-connected discharge lamps. As shown in FIG. 5, the ballast circuit 100 comprises a lamp driving circuit 104, a capacitive coupling circuit 106, and a controller 105 that controls the respective operations of the lamp driving circuit 104 and the capacitive coupling circuit 106. The lamp driving circuit 104 comprises a low-frequency voltage source 108 (e.g., a low-frequency square wave drive) coupled to a first terminal 22 of each discharge lamp of the array of parallel-connected discharge lamps 102. A second terminal of each discharge lamp of array 102 is further coupled to a current control circuit 110, which in turn is coupled to the voltage source 108. In one embodiment, the current control circuit 110 comprises individual current controller circuits for each discharge lamp of the array 102. Where the voltage source 108 comprises a low-frequency square wave drive, for example, the drive switches the cathode electrode of the discharge lamps periodically and can result in substantially equal electrode deterioration and extended lamp life.

The capacitive coupling circuit 106 comprises an igniter circuit 116 and a conductive element 118 (e.g., a conductive foil, plate, one or more strips, or other conductive material) disposed adjacent to the parallel array 102 of discharge lamps. The capacitive coupling circuit is used to capacitively couple the discharge lamps of the array 102 to ground during ignition of the discharge lamps. As described above with respect to FIG. 1, the igniter circuit 116 may provide a high-frequency voltage signal to the conductive element 118 prior to and/or during the ignition of the array 102 of parallel connected discharge lamps in order to capacitively couple the discharge lamps of the array 102 prior to and/or during their ignition.

Lamp ignition is achieved by providing a low-frequency voltage signal across the electrodes of the discharge lamps in the array 102 and a short pulse application of a high-frequency voltage signal to the conductive element 118. The short pulse of high-frequency voltage, for example, may be provided prior to or during the application of the low-frequency voltage signal to the electrodes of the discharge lamps. In one embodiment, the igniter circuit temporarily provides sufficient energy via capacitive coupling for the applied low-frequency voltage signal supplied by the voltage source 108 to initiate a breakdown phase in the discharge lamps of the array 102. In one implementation, for example, the discharge lamps may be ignited at an applied low-frequency voltage signal of about the normal operation voltage of the lamps.

The current control circuit 110 is disposed in series with the discharge lamps of the array 102 in order to provide current limiting, maintain a stable arc, and regulate DC current through the discharge lamps. In one embodiment, for example, the current control circuit 110 comprises a single integrated circuit for a plurality of individual current control circuits for a plurality of corresponding discharge lamps.

The controller 105 provides drive signals for the lamp driving circuit 104 and the capacitive coupling circuit 106. The controller 105 may provide, for example, drive signals for high-voltage DC-DC converters, low frequency switches, the igniter circuit, and/or the current control circuit 110 for dimming control. For lamp ignition, for example, a high voltage low-frequency signal can be ramped up together with the capacitively coupled ignition current. The controller then monitors a total lamp array current through a current sense feedback and continues ignition until each discharge lamp in the array is lighted (e.g., based on total current sensed). For normal operation, however, the controller 105 may adjust the low-frequency voltage signal to minimize the voltage across the current control circuits for improved efficiency. The controller 105 may also control lamp re-ignition for failed lamps by attempting to re-apply the ignition current.

The controller 205, for example, may be implemented in (1) any number of hardware implementations using analog components or custom digital logic, such as in digital logic implemented on one or more programmable logic chips (e.g. a field programmable gate array (FPGA) or complex programmable logic devices (CPLD)), application specific integrated circuits, or custom digital or mixed-signal controller chips; (2) any number of software implementations, such as using microcontrollers, microprocessors, or digital signal processors (DSP) that execute a control method written as software code in an implementation; or (3) any combination of hardware and software implementations.

Figure 6:
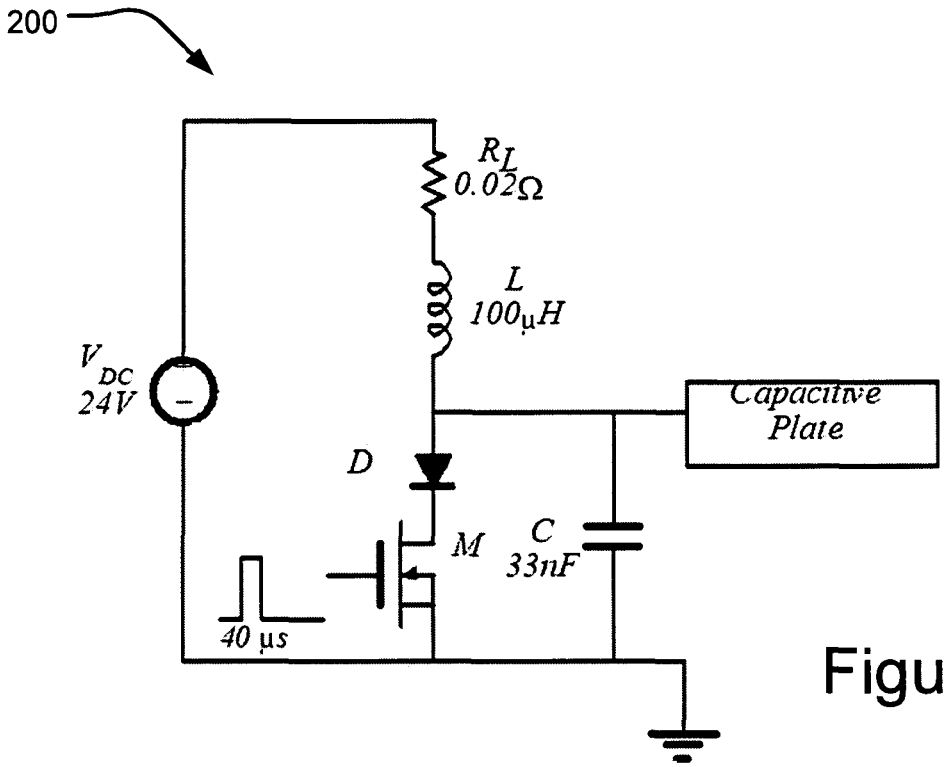
FIG. 6 shows a block diagram of an exemplary igniter circuit.

FIG. 6 shows a block diagram of an exemplary igniter circuit 200. The exemplary igniter circuit, for example, may be used within a ballast circuit, such as the ballast circuit shown in FIG. 5. The igniter circuit 200 is used to drive a conductive element with a short pulse or short pulses for the ignition of discharge lamps (e.g., cold-cathode lamps such as CCFLs). The applied voltage required to provide sufficient energy via capacitive coupling for the applied low-frequency voltage signal supplied by the voltage source to initiate a breakdown phase in the discharge lamps of the array depends on many factors, such as the lamp characteristics, temperature, and distance between the lamp sidewall and the conductive element.

As shown in FIG. 6, the igniter circuit comprises a MOSFET switch M and a series resonant LC circuit in which a voltage across a capacitor C is used to drive the conductive element. In one embodiment, for example, the igniter circuit is designed to generate a damped sinusoidal output voltage with a peak voltage of about $V_o$=500 V at an oscillation frequency $f_c$ of about 85 kHz or about 250 kHz. In this embodiment, the ignition voltage can be controlled by varying the pulse-width of the gating signal applied to the MOSFET M and the oscillation frequency can be selected by switching the capacitor C value from about 33 nF to about 4.7 nF.

Depending on the requirements of the ballast circuit (e.g., operation with pulses in the few hundred volt peak range with a sinusoidal pulse period of about ten microseconds with a fast decay time), a wide range of resonant converter or pulse generator approaches may be suitable for the ignition circuit.

Figure 7:
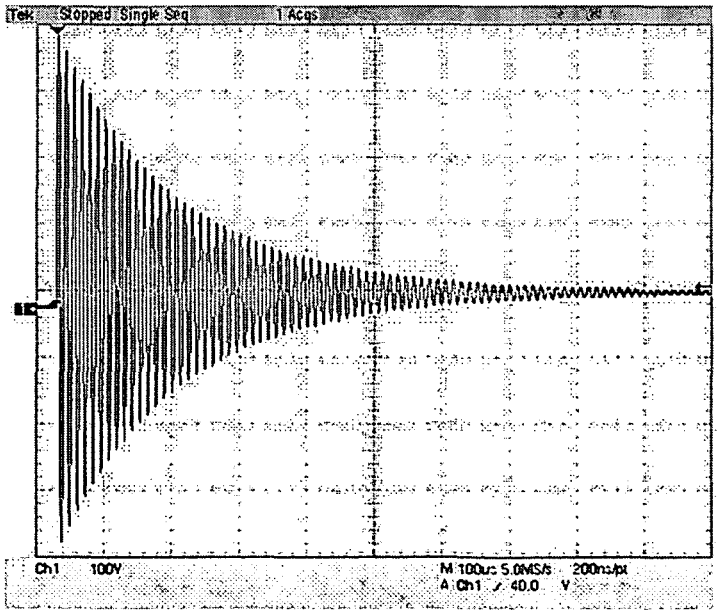
FIG. 7 shows an exemplary igniter circuit output voltage waveform.

FIG. 7 shows an exemplary igniter circuit output voltage waveform in which the waveform comprises a peak voltage $V_{pk}$ of about 380 V and a frequency of about 85 kHz.

Variable frequency control can be used to study the required characteristics for parallel lamp ignition under various conditions. Additionally, delay logic can be used to introduce a variable delay between an ignition pulse and an application of a lamp voltage to study effects of ignition performance under various timing conditions.

Figure 8:
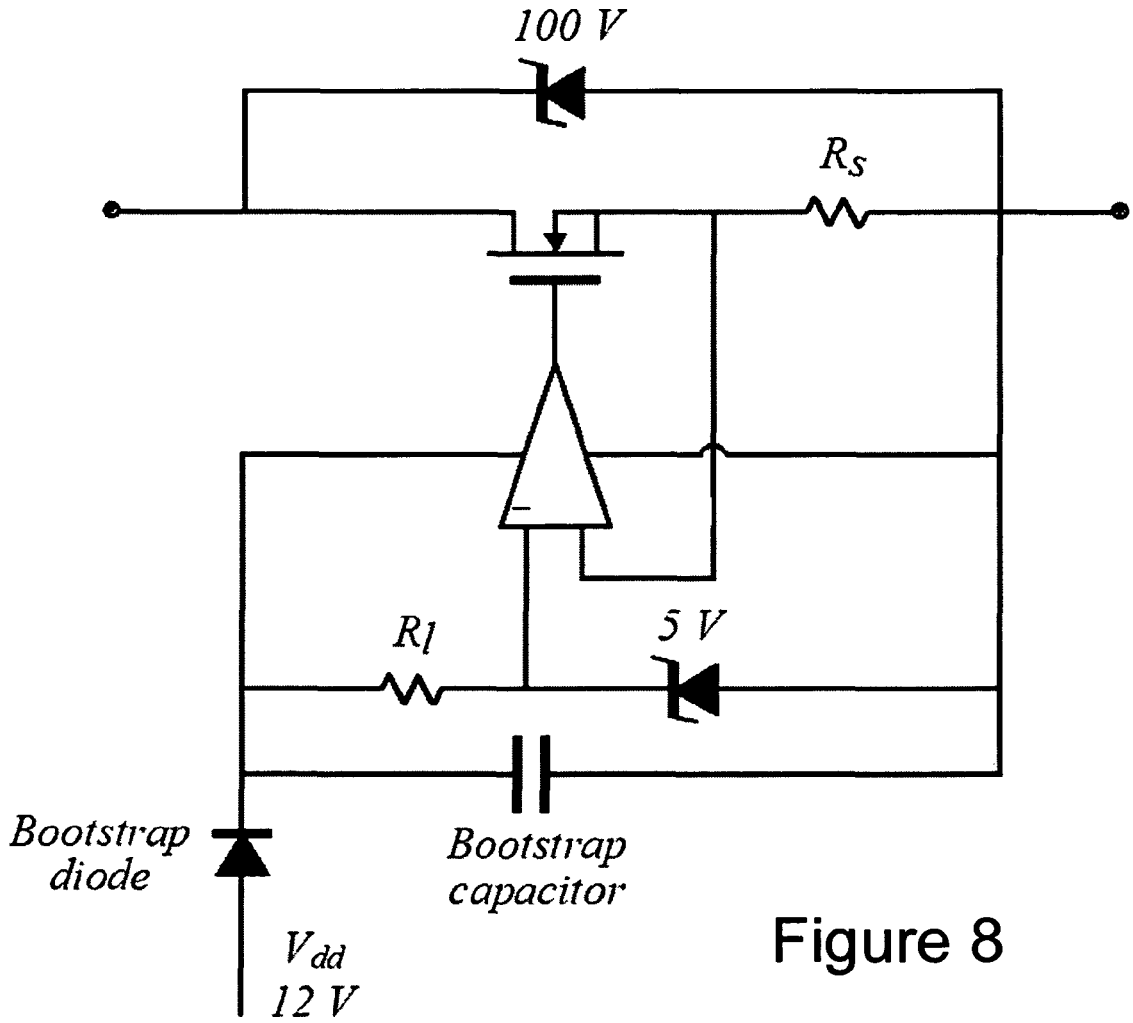
FIG. 8 shows a block diagram of an exemplary current control circuit.

FIG. 8 shows a block diagram of an exemplary current control circuit 210. The exemplary current control circuit, for example, may be used within a ballast circuit, such as the ballast circuit shown in FIG. 5. The current control circuit 210, for example, can be disposed in series with each lamp of an array of parallel discharge lamps (e.g., CCFLs) to stabilize individual lamp currents and provide consistent lumen output across the array. As discussed above, the current control circuits may be able to block a maximum lamp-to-lamp voltage variation plus a safety margin. For a low-frequency drive, for example, operational voltages for similar lamps may vary by less than about 20 V. Such a low blocking voltage allows active devices to be used for current control while still maintaining high efficiency. Passive circuits are also suitable for current limiting, but do not facilitate active control for continuous and pulse-width modulation (PWM) dimming.

The implementation the current control circuit 210 shown in FIG. 8 comprises a MOSFET or other active device is used as a unidirectional current source to provide high impedance current limiting in series with the lamp. Two unidirectional current control circuits are connected in series with each lamp in which one is made active for each polarity of the DC voltage. Each device can be powered from a low-frequency boot-strap diode as shown or could be biased from its drain voltage. The device acts as a short circuit for negative voltages when the opposite device is regulating. Over-voltage protection can be used to protect against high-voltage levels during transients. A bidirectional current regulating circuit could also be designed, allowing the use of one current control circuit in series with each lamp (as shown in FIG. 5). Amplitude as well as PWM dimming can be implemented by controlling the bias/reference voltages supplied to the current control circuits. Current sensing can also be used by the primary controller to detect lamp ignition or failure and to fine tune the output voltage to minimize voltage stress and improve efficiency on the current control devices.

For the circuit shown in FIG. 8, a reference voltage is generated from the control supply voltage by using a zener diode circuit, which can be substituted by a bandgap reference circuit for better precision and performance. A high voltage zener diode is connected in parallel with the MOSFET device to provide for over voltage protection. The op-amp feedback circuit is used to improve noise performance and DC lamp current regulation. The lamp current is set using an appropriate value of resistor $R_s$ and the voltage across the $R_s$ resistor is used to measure the individual lamp currents.

Although several embodiments of this invention have been described above with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A method of aiding ignition in a discharge lamp, the method comprising:

applying a voltage across a pair of electrodes of a discharge lamp; and capacitively coupling the discharge lamp via an independent ignition coupling voltage source, wherein the capacitive coupling of the discharge lamp induces a current in the lamp to lower an ignition voltage of the discharge lamp.

2. The method of claim 1 wherein the operation of applying a voltage comprises applying a low-frequency voltage signal across the pair of electrodes of the discharge lamp.

3. The method of claim 2 wherein the independent ignition coupling voltage source comprises a high-frequency voltage source.

4. The method of claim 3 wherein the operation of capacitively coupling the discharge lamp comprises providing a short pulse application of a high-frequency voltage signal to a conductive element via the high-frequency voltage source.

5. The method of claim 1 wherein the operation of capacitively coupling the discharge lamp comprises coupling a conductive element to a ground via a switch.

6. The method of claim 5 wherein the conductive element is isolated from the ground by opening the switch after the discharge lamp is ignited.

7. The method of claim 1 wherein the operation of capacitively coupling the discharge lamp comprises providing a conductive element juxtaposed along at least a portion of the discharge lamp.

8. The method of claim 7 wherein the operation of capacitively coupling the discharge lamp comprises applying at least one voltage pulse to the conductive element.

9. The method of claim 7 wherein the operation of capacitively coupling the discharge lamp to ground comprises applying a high-frequency voltage signal to the conductive element.

10. The method of claim 7 wherein the operation of capacitively coupling the discharge lamp comprises coupling the conductive element to ground via a switch.

11. The method of claim 1 further comprising providing a current control circuit in series with the discharge lamp.

12. The method of claim 1 wherein the operation of applying a voltage across a pair of electrodes further comprises applying the voltage across a second pair of electrodes of a second discharge lamp disposed in parallel with the discharge lamp.

13. The method of claim 12 further comprising providing a first current control circuit in series with the discharge lamp and providing a second current control circuit in series with the second discharge lamp.

14. The method of claim 1 wherein the discharge lamp comprises a cold-cathode fluorescent lamp.

15. A circuit for aiding ignition in a discharge lamp comprising a first electrode and a second electrode, the circuit comprising:

a lamp drive circuit comprising a voltage source coupled to a first terminal and a current controller coupled to a second terminal, said first and second terminals being configured to couple to a corresponding one of the first electrode and the second electrode of the discharge lamp, said voltage source being configured to provide a voltage signal at said first terminal and said current controller being configured to control a current received via the second terminal; and a capacitive coupling circuit comprising an ignition coupling voltage source coupled to a conductive element configured to capacitively couple the discharge lamp, wherein said ignition coupling voltage source is configured to apply a coupling voltage to said conductive element to induce a current in the discharge lamp to lower an ignition voltage of the discharge lamp.

16. The circuit of claim 15 wherein said voltage source comprises a low-frequency voltage source.

17. The discharge lamp circuit of claim 16 wherein said ignition coupling voltage source comprises a high-frequency voltage source.

18. The circuit of claim 17 wherein said ignition coupling voltage source is adapted to apply a short pulse application of a high-frequency voltage signal to said conductive element.

19. The circuit of claim 15 wherein the conductive element is coupled to a ground via a switch.

20. The circuit of claim 19 wherein said conductive element is isolated from the ground by opening said switch after the discharge lamp is ignited.

21. The circuit of claim 15 wherein the conductive element is juxtaposed along at least a portion of the discharge lamp.

22. The circuit of claim 15 wherein said ignition coupling voltage source is configured to apply a high-frequency voltage signal to said conductive element.

23. The circuit of claim 15 wherein said conductive element is coupled to ground via a switch.

24. The discharge lamp circuit of claim 15 wherein said voltage signal comprises a low-frequency voltage signal.

25. The discharge lamp circuit of claim 24 wherein the low-frequency voltage signal comprises a low-frequency square wave voltage signal.

26. A discharge lamp circuit for aiding ignition in a discharge lamp comprising:

a discharge lamp comprising a first electrode and a second electrode;

a lamp drive circuit comprising a voltage source coupled to the first electrode of the discharge lamp, the voltage source being configured to provide a voltage signal at the first electrode and a current controller being configured to control a current received via the second electrode; and a capacitive coupling circuit comprising an ignition coupling voltage source coupled to a conductive element configured to capacitively couple the discharge lamp, wherein said ignition coupling voltage source is configured to apply a coupling voltage to said conductive element to induce a current in the discharge lamp to lower an ignition voltage of the discharge lamp.

27. The discharge lamp circuit of claim 26 wherein the discharge lamp comprises a cold-cathode fluorescent lamp.

28. The discharge lamp circuit of claim 26 wherein the voltage source comprises a low-frequency voltage source.

29. The discharge lamp circuit of claim 28 wherein said ignition coupling voltage source comprises a high-frequency voltage source.

30. The discharge lamp circuit of claim 29 wherein said ignition coupling voltage source is adapted to apply a short pulse application of a high-frequency voltage signal to said conductive element.

31. The discharge lamp circuit of claim 26 wherein the conductive element is coupled to ground via a switch.

32. The discharge lamp circuit of claim 31 wherein the conductive element is isolated from ground by opening the switch after the discharge lamp is ignited.

33. The discharge lamp circuit of claim 26 wherein the conductive element is juxtaposed along at least a portion of the discharge lamp.

34. The discharge lamp circuit of claim 26 wherein said ignition coupling voltage source is configured to apply a high-frequency voltage signal to the conductive element.

35. The discharge lamp circuit of claim 26 wherein the conductive element is coupled to ground via a switch.

36. The discharge lamp circuit of claim 26 further comprising a second discharge lamp comprising a third electrode and a fourth electrode wherein the voltage source is further coupled to the third electrode and is configured to apply the voltage signal at the third electrode.

37. The discharge lamp circuit of claim 36 further comprising a second current controller coupled to the fourth electrode and configured to control a current received via the fourth electrode.

38. The discharge lamp circuit of claim 26 wherein the voltage signal comprises a low-frequency square wave voltage signal.

* * * * *